United States Patent [19]

Edholm et al.

[11] Patent Number: 4,634,522

[45] Date of Patent: Jan. 6, 1987

[54] ARRANGEMENT IN MACHINES FOR SEPARATING MATERIALS HAVING DIFFERENT AERODYNAMIC PROPERTIES

[75] Inventors: Thomas Edholm, Staffanstorp; Ulf Ståhl, Höllviksnäs, both of Sweden

[73] Assignee: Kamas Industri AB, Vellinge, Sweden

[21] Appl. No.: 770,360

[22] Filed: Aug. 28, 1985

Related U.S. Application Data

[63] Continuation of Ser. No. 447,950, Dec. 8, 1982, abandoned.

[30] Foreign Application Priority Data

Dec. 10, 1981 [SE] Sweden ..... 8107399

[51] Int. Cl.[4] ..... B07B 11/04

[52] U.S. Cl. ..... 209/154; 73/861.73; 99/600; 209/36

[58] Field of Search ..... 209/44.1, 44.2, 552, 209/600, 643, 932, 28, 154, 502, 36, 21–23, 29, 509, 555, 557, 631, 634, 139 R; 73/861.41, 861.73; 340/609–611; 324/71.4; 99/609, 600

[56] References Cited

U.S. PATENT DOCUMENTS 4,330,400 5/1982 Schmidt ..... 209/502

FOREIGN PATENT DOCUMENTS 2342091 3/1975 Fed. Rep. of Germany .
2552308 6/1977 Fed. Rep. of Germany .
3020249 12/1980 Fed. Rep. of Germany .
80/00132 2/1980 PCT Int'l Appl. .
417284 3/1981 Sweden .
1384882 2/1975 United Kingdom ..... 73/861.73

*Primary Examiner*—David A. Scherbel
*Assistant Examiner*—Donald T. Hajec
*Attorney, Agent, or Firm*—Merchant, Gould, Smith, Edell, Welter & Schmidt

[57] ABSTRACT

An arrangement in machines for separating materials having different aerodynamic properties and employing an air current for actuating the materials.

A sensor is located in the path of particles carried along by the air current, to generate electric signals in dependence on particles impinging the sensor. The sensor is operatively connected to a control for regulating the flow rate of the air current in order to obtain an air flow corresponding to a predetermined impingement intensity.

1 Claim, 1 Drawing Figure

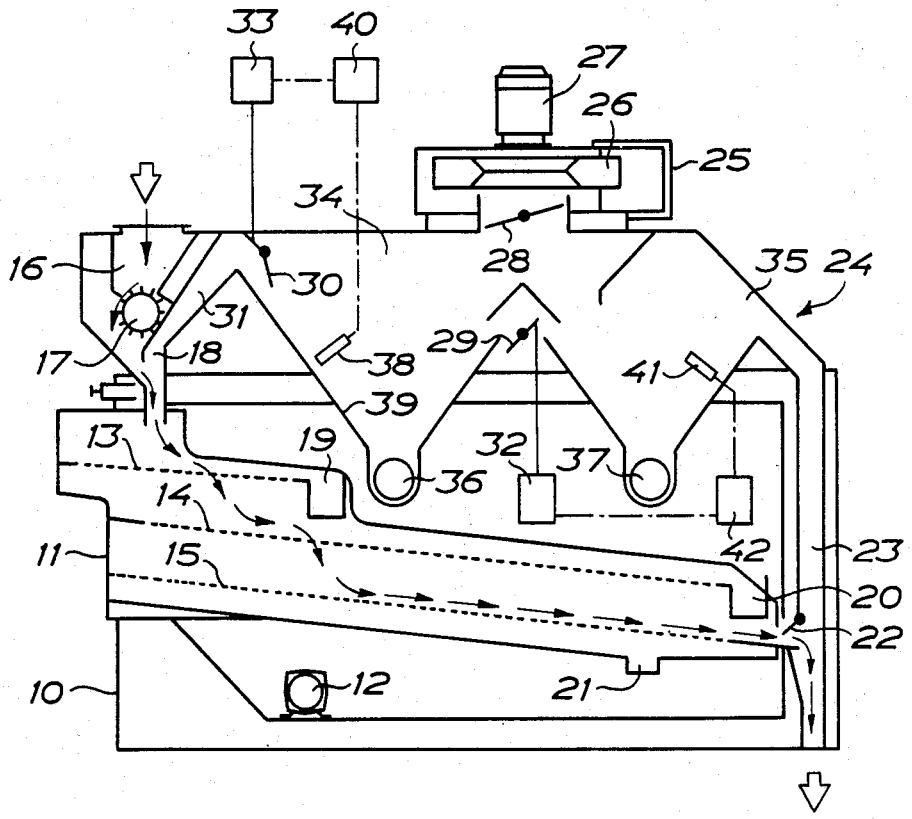
33
40
27
26
25
34
28
35
24
16
30
31
29
17
18
38
41
39
13
19
32
37
36
14
42
23
11
15
20
22
10
12
21

ARRANGEMENT IN MACHINES FOR SEPARATING MATERIALS HAVING DIFFERENT AERODYNAMIC PROPERTIES

This is a continuation of application Ser. No. 447,950, filed Dec. 8, 1982 now abandoned.

TECHNICAL FIELD

The invention relates to machines for separating materials having different aerodynamic properties, comprising means for generating an air current actuating the materials, means for controlling the flow rate of the air current, means for adjusting said control means, and a sensor operatively connected to said adjusting means for controlling the flow rate of the air current in dependence on the sensor. The aerodynamic properties can relate e.g. to density, particle form and particle size of the materials to be processed in the machine.

BACKGROUND OF THE INVENTION

Air sorting and/or air screening is applied in sorting and screening machines for sorting and/or screening grain, seeds, and similar materials in order to separate from the materials chaff, husks, shells, empty grains and other light materials which are included in the row material but should not be present in the good product. It is of course important to perform this sorting or screening operation as effectively as possible. This requires a strong air flow but on the other hand the air flow cannot be allowed to rise to any high level because the good grains which shall be included in the good product and comprise the heavier particles of the row material, in that case will also be carried away by the air current. Thus, it is a matter of adjusting very accurately the air flow such that at the most single grains only of the good product are carried away by the air current; then, it is pretty sure that there will be obtained an effective separation of the lighter materials which one want to get rid of although it is achieved at the cost of some loss, though a small one, of good product.

The air flow accordingly must be set accurately and carefully, and it may be necessary to adjust from time to time the setting, initially made, when the sorting or screening machine is operating, and it may also be necessary of course to use different settings for different types of material. This means that the machine when operating requires supervision by a skilled person if one does not want to run the risk of too high a loss of good product or, alternatively, will not be satisfied with an inferior sorting or screening result due to an air flow which is too strong or too light, respectively.

SUMMARY OF THE INVENTION

The object of the invention is to make possible an automatic adjustment of the air flow in order to achieve an optimal actuation of the material to be sorted or screened, and in order to achieve this object in machines of the kind referred to above the invention provides the arrangement wherein the sensor is located in the path of particles carried along by the air current, to generate electric signals in dependence on particles impinging the sensor, and is connected to said adjusting means through a function circuit for setting, over the control means, the air flow at a value corresponding to a predetermined impingement intensity.

The invention will be described in more detail below, reference being made to the accompanying drawing in which a diagrammatic vertical sectional view discloses one embodiment of a sorting and screening machine arranged in accordance with the invention.

BRIEF DESCRIPTION OF THE DRAWING

The FIGURE is a schematic representation of a machine according to the present invention.

DETAILED DESCRIPTION OF THE PREFERRED EMBODIMENT

The machine proper is of an embodiment already known per se. The machine includes a frame 10 having a screen shoe 11 elastically suspended therein, which is driven in a known manner by means of a shaking motor 12. In the screen shoe there are arranged from top to bottom a scalper screen 13, a sorting screen 14, and a fine screen 15. For the supply of the material to be screened there is provided above the scalper screen an inlet funnel 16 having a feed roll 17 with a variator, for the supply of the material to be screened through a rising sifter 18. For the removal of scalp-overs from the scalper screen 13 and the sorting screen 14 discharge chutes 19 and 20, respectively, are provided, and for material passing through the fine screen, such as sand and kernel parts, a discharge chute 21 is provided. The scalp-overs from the fine screen constitute the good product, and for this product an outlet 22 controlled by a throttle is provided which opens into a rising sifter 23.

The top portion of the machine comprises an aspiration compartment 24 provided with a fan housing 25 on the top thereof, said fan housing mounting a fan 26 and a drive motor 27. A main air throttle 28 is provided between the fan housing and the aspiration compartment. The two rising sifters 18 and 23 communicate with the aspiration compartment, and for the control of the air flow through these two rising sifters a throttle 29 for the supply of false air from the outside into the aspiration compartment as well as a throttle 30 for controlling the connection between the aspiration compartment 24 and the rising sifter 18 through a connection passage 31 are provided. Adjustment means 32 and 33 are connected to the throttles 29 and 30, respectively, and such means can be of the electric, pneumatic or hydraulic type of a known construction, such as a solenoid or a pneumatic or hydraulic piston-cylinder device. The rising sifter 18 and the rising sifter 23 are each connected to an expansion hopper 34 and 35, respectively, each having an outlet 36 and 37, respectively.

The operation of the sorting and screening machine described will be explained briefly. The row material supplied at the inlet funnel 16 is fed by means of the feed roll 17 into the rising sifter 18 where the material will meet a counter-flowing air current. In this sifter so-called pre-aspiration takes place by means of this air current, straws, husks, chaff, and other light material included in the row material being carried away by the air current to be transported by said air current to the expansion hopper 34 where the material will precipitate due to the reduction of the air speed in the expansion hopper and can be removed through the outlet 36 at the bottom of the hopper. When the material has been sorted in the screen shoe 11 by means of the screens arranged therein, the good product will be discharged at the throttle-controlled good product outlet 22 into the rising sifter 23 where the good product meets a counter-flowing air current. Empty grains in the good product, which have not been separated earlier due to the fact that they have the proper size, will be carried away by said air current as well as shells and husks, if any, still included in the good product. This material will be carried into the expansion hopper 35 by the air current, where it is separated to be discharged through the outlet 37 at the bottom of said expansion hopper. That portion of the good product, which is not carried away by the air current in the rising sifter 23, will be discharged through the lower end of the rising sifter as good product.

In order that good grains of the proper size shall not be carried away by the air current in the rising sifter 18 and the rising sifter 23, respectively, it is important that the air flow through these two sifters is adjusted in a correct manner as mentioned above. This is done by means of the throttles 29 and 30 and it is done automatically by the machine described being provided with the arrangement according to the invention. For this purpose there is arranged in the expansion hopper 34 a sensor 38 which is located adjacent a bounding wall 39 of the hopper. This location is chosen such that the sensor will be hit by heavier particles which are carried away by the air current through the rising sifter 18, lighter particles following a path spaced a greater distance from the wall 39 such that they will not hit the sensor 38. This means that only good grains will hit the sensor 38 while straws, chaff, husks, and other light impurity material will not hit the sensor. In other words, the sensor will sense such material that in fact should not be carried away by the air current through the rising sifter 18 but nevertheless will be carried away, if the air flow through the rising sifter is too strong. The sensor 38 can comprise e.g. a crystal microphone, a differential transformer or a dynamic pick-up which is mounted to a metal sheet arranged transversely of the wall 39. Any other type of sensor can be used; it is important, however, that the sensor generates an electric signal when the particles are impinging the sensor or the metal sheet supporting the sensor. The signal from the sensor 38 is supplied to a function circuit 40 (micro-processor) wherein the signal will be amplified and signals generated by lighter particles impinging the sensor or the metal sheet supporting the sensor are filtered from signals emanating from heavier particles. Although most lighter particles clear the sensor one particle or the other of this category may nevertheless hit the sensor. This filtering action can be performed by means of a discriminator included into the circuit. It is not necessary that the lighter particles clear the sensor but substantially all particles lighter as well as heavier may hit the sensor because said filtering action makes possible to distinguish between lighter and heavier particles. In dependence on the number of hits of heavier particles registered by the sensor 38 per time unit a signal is generated in the function circuit 40. Said signal is supplied to the adjusting means 33 for adjustment of the throttle 30 to such position that the number of hits against the sensor 38 or the metal sheet supporting the sensor, which are related to heavier particles, are below a maximum value preset in the function circuit 40 but at the same time also exceed a minimum value preset in said circuit. In this manner the throttle 30 will be adjusted to a position which provides an optimal air flow through the rising sifter 18, i.e. an air flow which carries away the lighter impurity material but on the contrary carries away the heavier kernels to be included in the good product to a minimum extent only. It is true that one kernel or the other is allowed to be carried away by the air current for generating the adjusting signal for the throttle 30 but this can be accepted considering the fact that an effective sifting can be maintained in the rising sifter 18. The position of the throttle will be continuously readjusted as is necessary in order to maintain an air flow in the rising sifter 18 which is within the limits preset in the micro-processor 40.

In the same manner a sensor 41 is located in the expansion hopper 35, and this sensor is connected to a function circuit 42 for adjustment of the throttle 29 by means of the adjusting means 32. The throttle 29 controls the supply of false air to both expansion hoppers 34 and 35, and by the adjustment of this throttle the air flow in both rising sifters 18 and 23 thus will be controlled. The relation between the flow rates in the two rising sifters is then controlled by means of the throttle 30. The control obtained by means of the throttle 29 thus can be considered a primary air flow control while the control obtained by means of the throttle 30 is a secondary air flow control.

The function circuit (micro-processor) 40 has not been described in more detail because the average man skilled in the art of electronics at the present state of the art would be able to construct suitable circuits and circuit components for achieving the function extensively described above.

The invention has been described with reference to a quite specific sorting and screening machine but it can of course be applied also to machines of other types wherein an air flow has to be controlled in dependence on the proportion between heavier and lighter particles in the material to be screened. In that case the control of the air flow can take place in another manner than by adjusting throttles, e.g. by adjusting the rotational speed of the fan.

In the embodiment described, the control is directly related to the biological properties of the material to be sorted or screened and the possibility to use such material as good product due to the fact that the sensor measures the amount of good product of a specific quality in the air fraction. The signal supplied by the sensor is a direct measure of the amount of material of an identified type, is independent of other factors, and indicates directly the efficiency of the final screening obtained in the air system.

It should be noted, however, that the invention is not limited by the illustrative embodiment described to machines for sorting and/or screening of grain, seeds, and similar materials but can be applied also to machines for separating other materials having different air dynamic properties, e.g. for separating material from plastics or rubber or for separating paper from plastics.

We claim:

1. A machine for separating lighter and heavier materials based on their different aerodynamic properties comprising feed means for supplying materials for separation, a generally vertical passageway in communication with said feed means at one end, a hopper in communication with said passageway at its other end, said hopper having at least one generally vertically sloping wall located adjacent said other end of the passageway, means for generating an air current to draw a portion of said materials through said passageway into said hopper, throttle means located at said other end of the passageway adjacent to but separated from said sloping wall, sensor means located adjacent but separated from said wall and below said throttle means and in the path of said deflected airborne materials to generate electric signals in response to material impinging the sensor, said throttle means for controlling the flow rate of the air current, means for adjusting said throttle means, and a function circuit connected to the sensor to receive the signal generated by the sensor, said function circuit being operatively connected to said adjusting means for controlling the flow rate of the air current in response to said sensor signal corresponding to predetermined impingement intensity, said feed means operating independently of said sensor, a second hopper adjacent said first hopper, second means for controlling the flow rate of air current located between said hoppers, said second hopper having a pair of walls, one adjacent said second controlling means and the other distant therefrom, second sensor means for detecting impingements thereon and adjusting said second controlling means, said second sensor means being located adjacent said other wall of said second hopper, said other wall being generally vertically sloping.

* * * * *